US006557518B1

(12) United States Patent
Albertson et al.

(10) Patent No.: US 6,557,518 B1
(45) Date of Patent: May 6, 2003

(54) CYLINDER DEACTIVATION APPARATUS

(75) Inventors: William Conrad Albertson, Clinton Township, MI (US); Frederick J. Rozario, Fenton, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/052,195

(22) Filed: Jan. 18, 2002

(51) Int. Cl.[7] ..... F02B 77/00

(52) U.S. Cl. ..... 123/198 F; 123/90.16; 123/90.55

(58) Field of Search ..... 123/198 F, 90.16, 123/90.12, 90.13, 90.15, 90.46, 90.55, 90.56, 90.57, 90.58, 90.59

(56) References Cited

U.S. PATENT DOCUMENTS 5,119,774 A * 6/1992 Krieg et al. ..... 123/90.55

* cited by examiner

*Primary Examiner*—Noah Kamen
(74) *Attorney, Agent, or Firm*—Leslie C. Hodges

(57) ABSTRACT

Cylinder deactivation apparatus includes a simplified hydraulic circuit that provides oil to lash adjusters and to cylinder deactivation control passages through restricted passages adjacent the lash adjusters. A control valve, when open, delivers full pressure oil to the lash adjusting mechanisms while the restricted passages allow oil flow to purge air from the control passages but limit control oil pressure so that the valves are operated normally. When the control valve is closed, pressure in the control passages quickly increases, deactivating the valves of the deactivation cylinders. The flow of oil through the control passages when the valve is open is adequate to purge gaseous vapors such as air from the control passages and maintain the system in condition for prompt deactivation of the cylinders when the valve is closed.

6 Claims, 4 Drawing Sheets

CYLINDER DEACTIVATION APPARATUS

TECHNICAL FIELD

This invention relates to engine cylinder deactivation apparatus and more particularly to apparatus including a simplified hydraulic circuit providing both cylinder deactivation and air purge functions.

BACKGROUND OF THE INVENTION

It is known in the art of engine cylinder deactivation to provide switchable hydraulic lash adjusters operable to either actuate the valves of a deactivation cylinder or to maintain the valves closed through lost motion features of the hydraulic lash adjusters. Similar mechanisms may be provided in hydraulic valve lifters which include internally hydraulic lash adjusting mechanisms and so may also be referred to broadly as hydraulic lash adjusters.

Conventional lash adjusters are supplied with pressurized oil through a lash adjuster gallery or lifter gallery to annular feed grooves or intake ports which admit pressurized oil to take up the lash in the valve train between the valve and its associated tappet or other actuator. Lash adjusters and valve lifters with cylinder deactivation mechanisms have additional ports for lock pins, which connect through control passages and a control channel with a valved oil pressure supply. A three-way solenoid-actuated hydraulic control valve may be used to admit oil pressure to the lock pins for cylinder deactivation, or switching, of the lash adjusters in a supply mode of the three-way valve and to exhaust oil pressure from the oil passages and control gallery in an exhaust mode.

Such cylinder deactivation apparatus typically use complex systems of bypass channels and hydraulic bleeds in order to purge air or other gas/vapor from the system to insure consistent response to control signals. This is necessary to provide reliable actuation or deactivation of the switchable hydraulic lash adjusters in the apparatus when the hydraulic control valve is actuated to make a change in operation. These bleed and bypass systems may add considerable complexity to the deactivation apparatus itself. Thus, a simplified system for purging gas/vapor, primarily air, from the hydraulic cylinder deactivation apparatus is desired.

SUMMARY OF THE INVENTION

The present invention provides cylinder deactivation apparatus having a simplified hydraulic circuit featuring a single oil supply which supplies oil to both conventional and deactivation valve lifters for lubrication of the mechanism and operation of internal lash adjusters. The single oil supply further provides oil to cylinder deactivation control passages through one or more restricted passages or orifices adjacent the lash adjusters. A control valve in the control passages remains open to drain oil flow from the control passages or closes to prevent the exhaust of oil from the control passages.

When the valve is open, full pressure oil is delivered to the lash adjusting mechanisms while the restricted passages limit oil flow to the control passages. This limits oil pressure in the control passages to a level below that required to operate the deactivation or switching mechanisms of the lash adjusters so that the valves are operated normally and the cylinders are not deactivated. When the valve is closed, pressure in the control passages quickly increases to the oil supply pressure, causing the deactivation mechanisms of the deactivation lifters or lash adjusters to release the lock pins and deactivate the valves of the cylinders having deactivation lifters or lash adjusters. The flow of oil through the control passages when the valve is open is adequate to purge gaseous vapors such as air from the control passages and maintain the system in condition for prompt deactivation of the cylinders when the valve is closed.

These and other features and advantages of the invention will be more fully understood from the following description of certain specific embodiments of the invention taken together with the accompanying drawings.

DESCRIPTION OF THE PREFERRED EMBODIMENT

Figure 1:
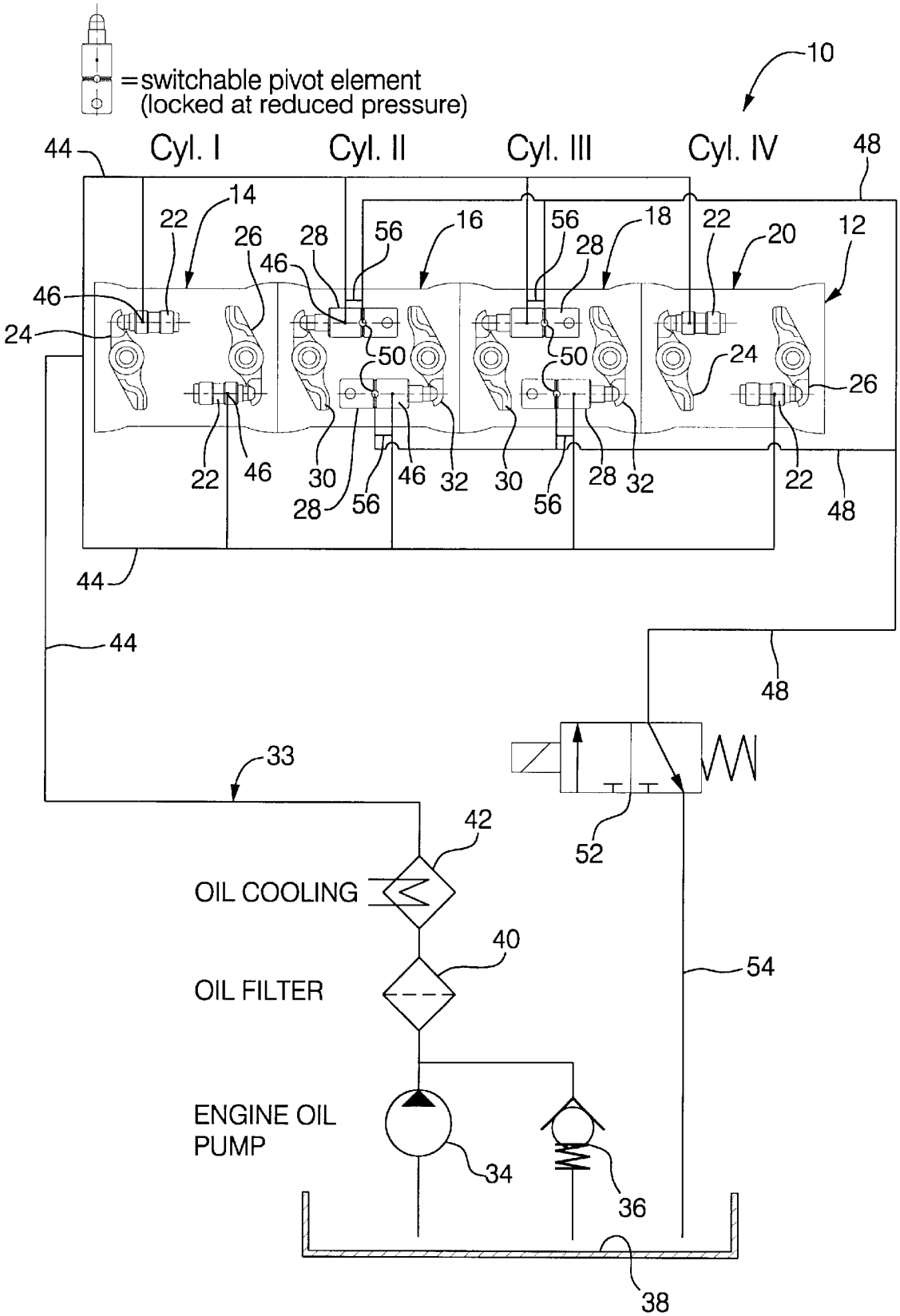
FIG. 1 is a diagrammatic view of an apparatus in accordance with the invention having a switching oil circuit shown in the valve de-energized position.
Figure 2:
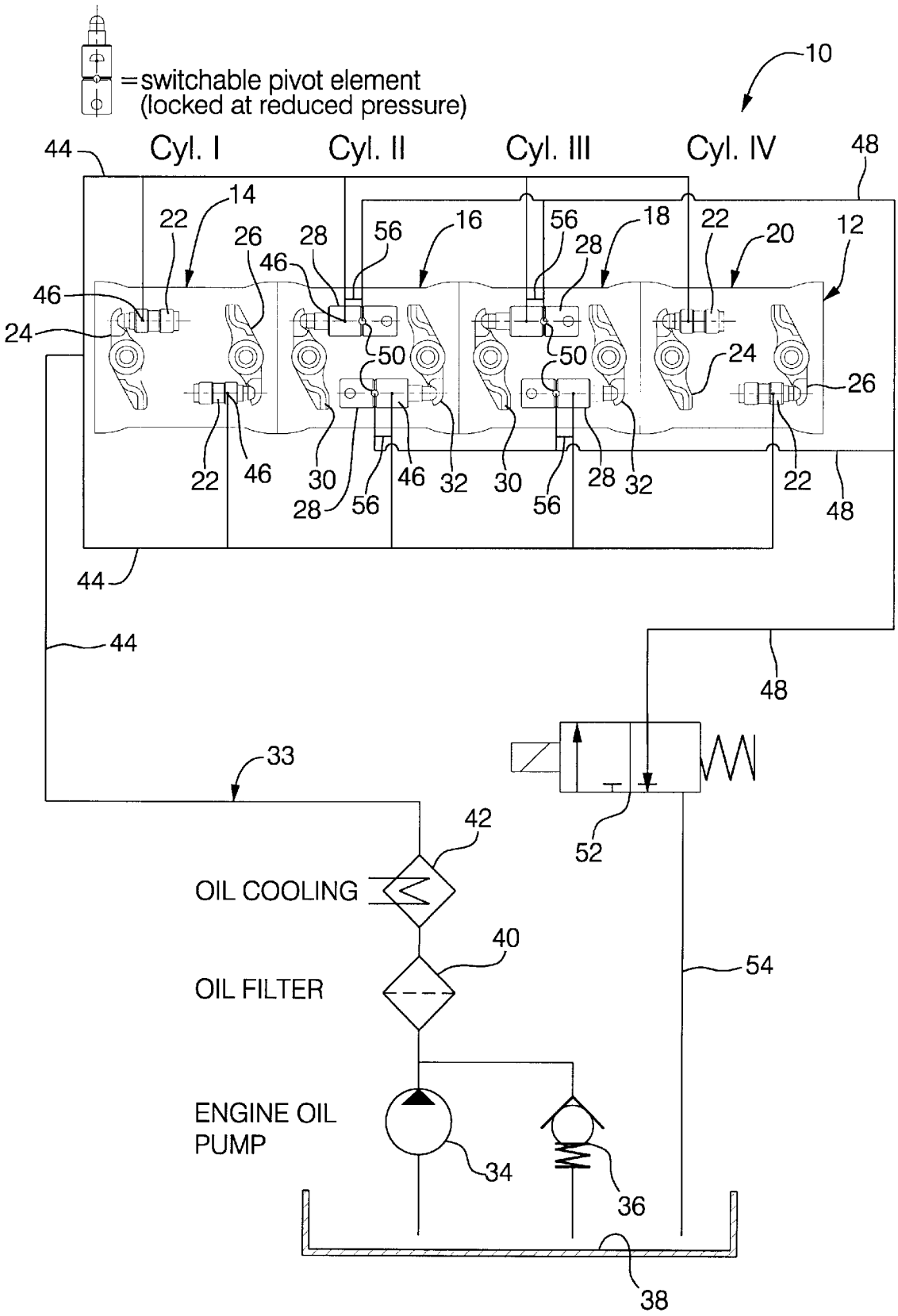
FIG. 2 is a view similar to FIG. 1 wherein the switching oil circuit is shown in the energized position.

Referring first to FIGS. 1 and 2 of the drawings in detail, numeral 10 generally indicates a first embodiment of cylinder deactivation apparatus having a single oil supply in accordance with the invention. Numeral 12 represents a single cylinder bank having four cylinders 14, 16, 18, 20. The end cylinders 14 and 20 are provided with conventional hydraulic lash adjusters 22 acting as pivots for inlet and exhaust valve roller followers 24, 26. The center cylinders 16, 18 are provided with deactivation lash adjusters 28 acting as pivots for inlet and exhaust roller followers 30, 32.

The lash adjusters and roller followers are provided with pressure oil lubrication through an oil circuit 33 having a conventional oil supply comprising an engine oil pump 34 having a pressure relief valve 36 discharging to an oil sump 38. The oil pump feeds through an oil filter 40, an oil cooler 42 and pressure oil passages 44 which connect with pressure oil inlets 46 for each of the lash adjusters 22, 28. In all of the lifters, the pressure oil is used to lubricate the lifters and roller followers and to actuate the lash adjusting mechanisms within the lash adjusters.

The oil circuit 33 further includes control oil passages 48 which connect oil inlets 50 of only the deactivation lash adjusters 28 with a two-way control valve 52. Valve 52 has an open position shown in FIG. 1, wherein the valve connects the control oil passages 48 with a return line 54 to the oil sump 38, and an off position shown in FIG. 2 wherein the valve shuts off the escape of oil from the control passages 48. As is shown in the drawings, the pressure oil passages 44 and control oil passages 48 are connected by restricted passages 56 which are formed immediately adjacent or within the lash adjuster bodies and preferably connect the passages 44, 48 through restricted orifices formed in the passages 56.

In operation, pressure oil supplied through passages 44 to the end cylinders 14, 20 is used for lubrication and actuation of the conventional lash adjusters 22 which actuate the intake and exhaust valves of those cylinders during all engine operating conditions. Pressure oil delivered through passages 44 to the deactivation lash adjusters 28 is utilized for the same purposes including operating the intake and exhaust valves of those cylinders when the control valve 50 is in the open or exhaust position shown in FIG. 1. A limited amount of oil also flows through the restricted passages 56 of the deactivation lifters which, when the valve 52 is open, passes through the control passages and the valve to the sump 38. This oil flow purges the control passages of gaseous vapor, such as air, in the system so that proper operation of the deactivation mechanisms is available when needed.

When the valve 52 is shut off as shown in FIG. 2, oil flow through the passages 48 is blocked off so that pressure oil passing through restricted passages 56 raises the pressure in the oil inlets 50 of the deactivation lash adjusters 28 to essentially the pressure in the pressure oil passages 44. The increased pressure actuates the deactivation mechanisms of the deactivation lash adjusters to release lost motion members in the lash adjusters 28 and allow the lash adjusters to telescope so that the pivot function is deactivated and the valves of cylinders 16, 18 remain closed while the engine continues operating. When conditions occur which again require operation of the center cylinders 16, 18, the control valve 52 is again opened, allowing pressure in control passages 48 to drain. This reduces the pressure in the control passages, allowing the deactivation mechanisms in the lifters 28 to re-latch or re-engage so that they again operate normally to open and close the intake and exhaust valves of the center cylinders 16, 18.

Figure 4:
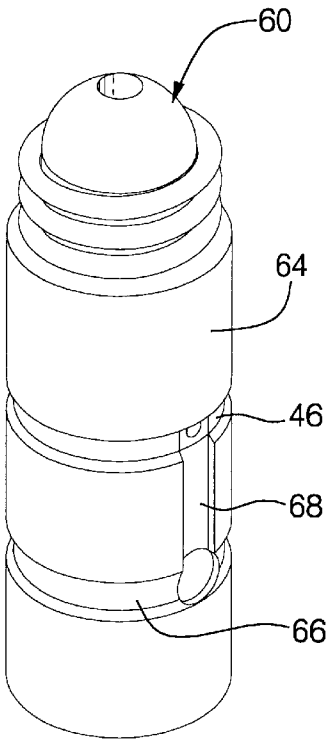
FIG. 4 is an enlarged pictorial view showing a lash adjuster as in FIG. 3.
Figure 3:
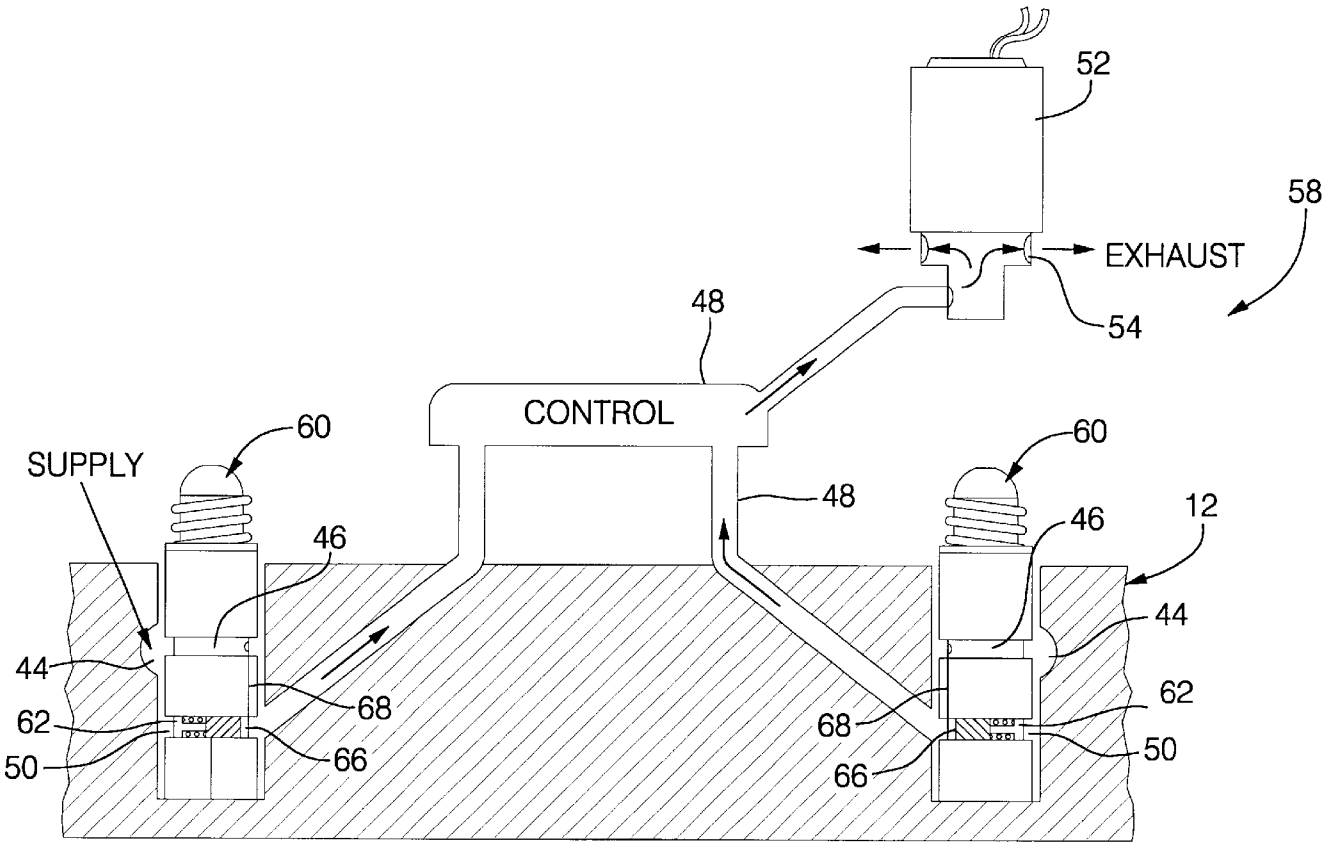
FIG. 3 is a diagrammatic view of an alternative embodiment showing stationary hydraulic lash adjusters having deactivation mechanisms supplied with oil through restricted feed grooves in the lash adjuster bodies in accordance with the invention.

Referring now to FIG. 3 of the drawings, numeral 58 indicates an alternative cylinder deactivation apparatus which is generally similar to that of FIGS. 1 and 2 and wherein like numerals indicate like parts. Apparatus 58 includes a lifter gallery forming part of a cylinder bank 12, only one cylinder of which is shown and in which are mounted deactivation lash adjusters 60. FIG. 4 shows an enlarged pictorial view of one of the lash adjusters 60. Apparatus 58 includes pressure oil passages 44 for feeding the lifters and control oil passages 48 connecting with deactivation oil inlets 50 in each of which a latching pin 62 is located. The control passages 48 connect as before with control valve 52 which is maintained in an open position connected to exhaust port 54 when the valve is de-energized.

Each lash adjuster 60, as illustrated, includes a stationary body 64 having an annular oil inlet groove 46 for the lash adjusting mechanism and an annular oil inlet groove 66 for the deactivation mechanism. In this embodiment, the restricted passages 56 illustrated in FIGS. 1 and 2 are replaced by restricted passages 68 formed as grooves in the bodies 64 of the lash adjusters connecting the annular oil inlets 46 with the deactivation oil inlet grooves 66 of the lash adjusters. These restricted passage grooves 68 provide the limited flow between the pressure oil in the lash adjuster inlet grooves 46 and the control pressure oil in the deactivation inlet grooves 66. The operation of the mechanism is the same as described to FIGS. 1 and 2 so that further description is not necessary.

Figure 6:
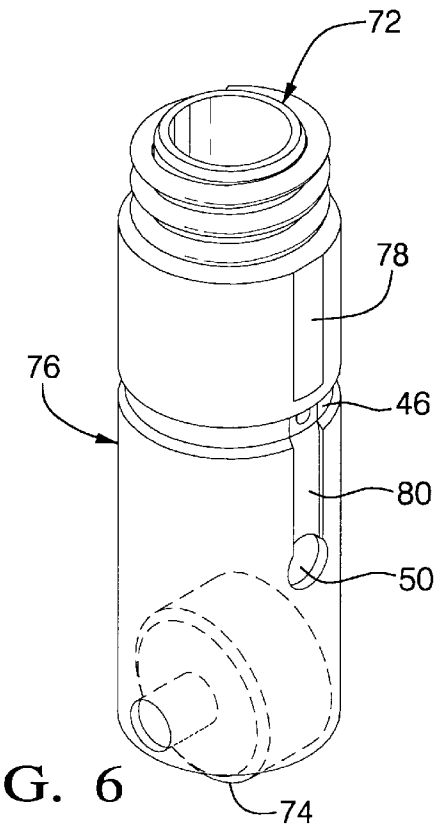
FIG. 6 is an enlarged pictorial view showing a deactivation valve lifter (lash adjuster) as in FIG. 5.
Figure 5:
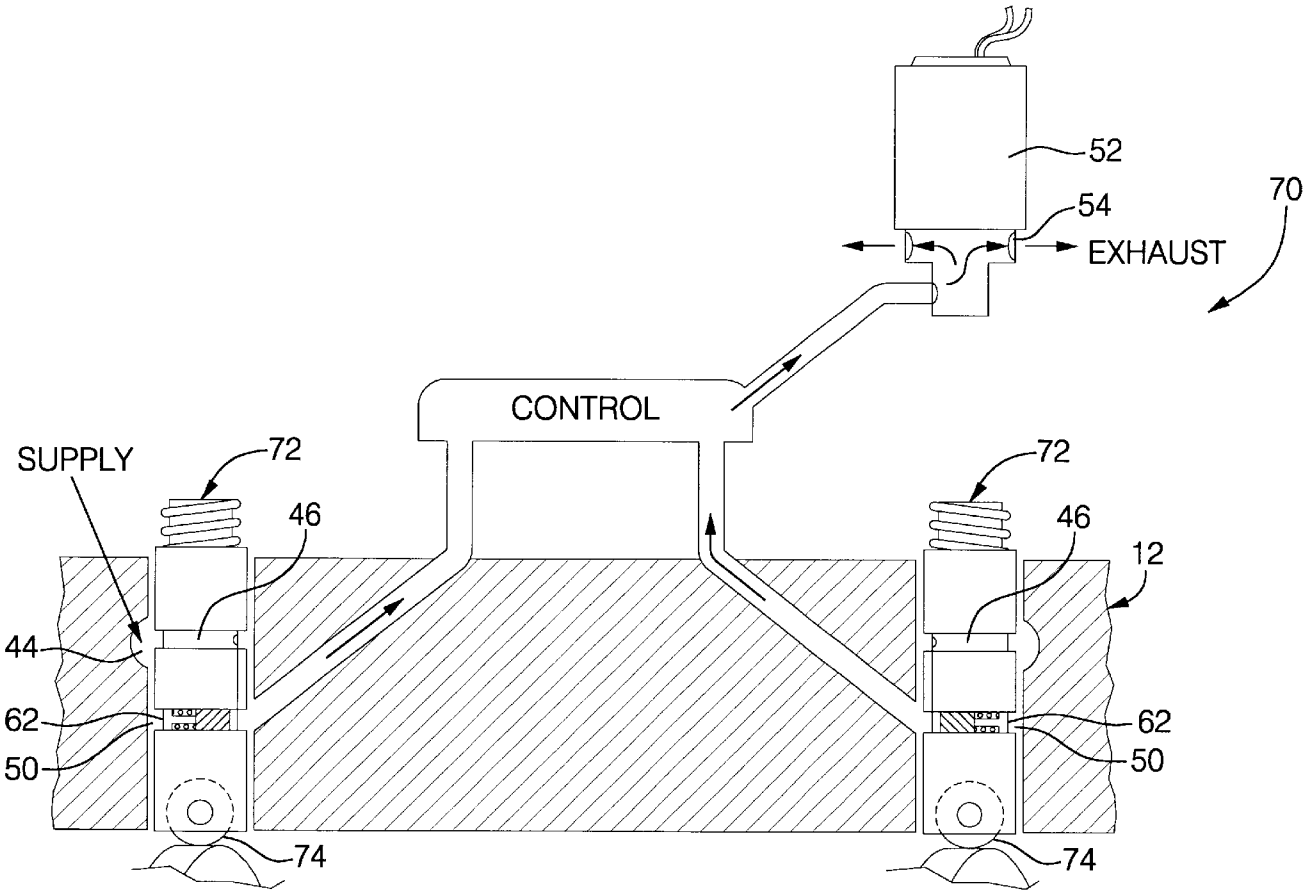
FIG. 5 is a view similar to FIG. 3 showing roller hydraulic lifters with internal lash adjusters and cylinder deactivation mechanisms supplied with oil through restricted feed grooves in the lifter bodies.

Referring now to FIGS. 5 and 6, there is shown still another embodiment of cylinder deactivation apparatus indicated by numeral 70. Apparatus 70 is identical to apparatus 58 except for the use of roller hydraulic valve lifters 72 in the place of the lash adjusters 60 of apparatus 58 The roller lifters include lash adjusting and deactivation mechanisms as do the lash adjusters 60 of apparatus 58 and are thus referred to generally as lash adjusters, or the like, as used in the claims. As is best shown in FIG. 6, lifters 72 differ from the lash adjusters of FIGS. 3 and 4 in the provision of a roller follower 74 at the lower end of the lifter body 76 for directly engaging a cam. The cam actuates the lifters reciprocably in the gallery portion of the cylinder block 12 and a flat 78 of the lifter body holds the follower in rotational alignment with the cam.

An oil inlet groove 46 is provided as in the lash adjusters 60 and an oil inlet opening 50 is formed which aligns with the control oil passages 48 of the apparatus. As in the case of the lash adjusters 60, a restrictive passage in the form of a shallow groove 80 is provided in the lifter body which connects the annular groove with the deactivation inlet opening 50. The operation of the lifter in controlling or actuating the intake and exhaust valves of its associated engine is functionally the same as that of the lash adjuster previously described except that the lifter itself reciprocates and drives a push rod or other device while the stationary lash adjuster acts as a pivot in the valve mechanism of its apparatus.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. Apparatus for selectively deactivating valves for specified cylinders of an engine, said apparatus comprising:

switchable hydraulic lash adjusters forming part of a valve train for actuating engine valves of the specified cylinders, the lash adjusters having lash adjusting portions for adjusting valve lash and adjacent switching portions operative to selectively actuate or release their respective valves in response to an increase or decrease of oil pressure supplied to the switching portions;

a gallery carrying said lash adjusters and including pressure oil passages connecting with the lash adjusting portions;

a pressure oil supply connected with said pressure oil passages;

at least one restricted passage connecting the pressure oil passages with the switching portions of the lash adjusters; and control passages connecting the switching portions of the lash adjusters with a control valve having a closed position cutting off flow and an open position allowing free flow through the control passages;

the restricted passage limiting oil flow to the control passages, when the control valve is open, to a rate operative to maintain pressure below that required to actuate the switching portions to release their respective valves but to permit oil flow adequate to purge gaseous vapor from the control passages;

whereby closing of the control valve increases pressure in the control passages to actuate the switching portions to deactivate their respective valves and opening of the control valve reduces pressure in the exhaust passages to re-engage the switching portions and reactivate their respective valves.

2. Apparatus as in claim 1 wherein one of said restricted passages is provided adjacent each of the switchable lash adjusters.

3. Apparatus as in claim 2 wherein said each lash adjuster includes a body having an oil inlet to the lash adjusting portions and an oil inlet to the switching portions and the restricted passage for each adjuster is formed within the body.

4. Apparatus as in claim 3 wherein the restricted passage is a groove communicating the oil inlets of the lash adjusting and switching portions.

5. Apparatus as in claim 1 wherein the lash adjuster is a stationary hydraulic adjuster capable of acting as a pivot for a valve actuating element.

6. Apparatus as in claim 1 wherein the lash adjuster forms part of a movable valve lifter.

* * * * *